US012405006B2

(12) United States Patent
Pawar

(10) Patent No.: US 12,405,006 B2
(45) Date of Patent: Sep. 2, 2025

(54) SYSTEMS AND METHODS FOR FLAME STRENGTH MONITORING IN GAS POWERED APPLIANCES

(71) Applicant: Copeland Comfort Control LP, St. Louis, MO (US)

(72) Inventor: Harshal Manik Pawar, Pune (IN)

(73) Assignee: Copeland Comfort Control LP, St. Louis, MO (US)

( * ) Notice: Subject to any disclaimer, the term of this patent is extended or adjusted under 35 U.S.C. 154(b) by 383 days.

(21) Appl. No.: 18/177,509

(22) Filed: Mar. 2, 2023

(65) Prior Publication Data

US 2024/0295321 A1 Sep. 5, 2024

(51) Int. Cl.

| | |
|---|---|
| ***F23N 5/12*** | (2006.01) |
| ***F23N 5/00*** | (2006.01) |
| ***F23N 5/24*** | (2006.01) |
| ***F23N 5/26*** | (2006.01) |

(52) U.S. Cl.

CPC ..... *F23N 5/123* (2013.01); *F23N 5/003* (2013.01); *F23N 5/242* (2013.01); *F23N 5/265* (2013.01); *F23N 2223/04* (2020.01); *F23N 2229/12* (2020.01); *F23N 2239/04* (2020.01)

(58) Field of Classification Search

CPC ..... F23N 5/123; F23N 5/003; F23N 5/242; F23N 5/265; F23N 2229/12; F23N 2239/04; F23N 2223/04

USPC ..... 431/75

See application file for complete search history.

(56) References Cited

U.S. PATENT DOCUMENTS

| | | | | |
|---|---|---|---|---|
| 4,000,961 | A * | 1/1977 | Mandock | F23N 5/242 431/78 |
| 4,082,493 | A * | 4/1978 | Dahlgren | F23N 5/242 431/46 |
| 4,178,149 | A | 12/1979 | Matthews | |
| 4,230,444 | A | 10/1980 | Matthews | |
| 4,242,079 | A | 12/1980 | Matthews | |
| 4,359,315 | A | 11/1982 | Matthews | |
| 4,823,114 | A * | 4/1989 | Gotisar | F23N 5/242 431/24 |
| 4,919,084 | A * | 4/1990 | Maurice | A01K 31/19 119/306 |

(Continued)

FOREIGN PATENT DOCUMENTS

JP 629808 B2 3/1987

*Primary Examiner* — Vivek K Shirsat

(74) *Attorney, Agent, or Firm* — Armstrong Teasdale LLP

(57) ABSTRACT

A gas powered appliance includes a main burner for burning gas, a flame sensor assembly, and a controller. The flames sensor assembly includes a probe positioned proximate the main burner to couple an electric current to the main burner through a flame on the main burner, a flame detector circuit providing a digital signal indicating presence or absence of the flame on the main burner based on the electric current, and a flame strength circuit receiving a voltage on a component of the flame detector circuit and outputting an analog signal based on the voltage. The controller is connected to the flame sensor assembly and programmed to control the main burner to receive the digital signal from the flame detector circuit, receive the analog signal from the flame strength circuit, and determine, based on the analog signal from the flame strength circuit, a strength of the flame.

20 Claims, 7 Drawing Sheets

(56) References Cited

U.S. PATENT DOCUMENTS

| | | | | |
|---|---|---|---|---|
| 5,073,769 | A * | 12/1991 | Kompelien | G08B 17/12 250/554 |
| 6,486,486 | B1 * | 11/2002 | Haupenthal | F23N 5/082 250/554 |
| 10,890,326 | B2 * | 1/2021 | Zuzuly | F23N 5/123 |
| 2002/0197575 | A1 * | 12/2002 | Neufield | F23Q 9/08 431/42 |
| 2004/0174265 | A1 * | 9/2004 | Kociecki | F23N 5/123 340/577 |
| 2004/0179329 | A1 * | 9/2004 | Iwaida | H01G 11/22 361/508 |
| 2006/0257805 | A1 * | 11/2006 | Nordberg | F23N 5/123 431/28 |
| 2012/0288806 | A1 * | 11/2012 | Racaj | F23N 5/123 431/18 |
| 2016/0047548 | A1 * | 2/2016 | Farley | F23N 5/123 126/116 A |
| 2016/0231023 | A1 * | 8/2016 | Engler | F24H 15/104 |
| 2018/0119955 | A1 * | 5/2018 | Zuzuly | F23N 5/123 |
| 2021/0231304 | A1 | 7/2021 | Broker | |
| 2021/0254826 | A1 * | 8/2021 | Kendrick | F23N 5/123 |
| 2023/0204210 | A1 * | 6/2023 | Selvakani | F23N 5/123 73/1.01 |
| 2023/0313989 | A1 * | 10/2023 | Mathew | F23N 5/022 431/75 |

* cited by examiner

SYSTEMS AND METHODS FOR FLAME STRENGTH MONITORING IN GAS POWERED APPLIANCES

FIELD

The field of the disclosure relates generally to gas powered appliances, and more particularly, to systems and methods for monitoring the strength of a flame in a gas powered appliance.

BACKGROUND

Gas powered appliances (such as a gas powered furnace, a gas powered oven, a gas powered water heater, and the like) include a burner at which gas is burned. Such appliances typically include a flame sensor to detect when a flame is present on the gas powered burner, so that gas is not emitted from the burner for extended periods of time when a flame is not present.

In at least some gas powered appliances, the flame sensor includes one or more electrodes positioned near the location of the expected flame from the gas powered burner. A voltage is applied to one of the electrodes. When no flame is present, there is no path for current from the electrode to which the voltage is applied, and no current flows from the electrode. When a flame is present on the burner, current will pass through the ionized gases of the flame from the electrode (e.g., to another electrode, to ground, to the burner, or the like). By monitoring for the presence or absence of this current (sometimes referred to as a flame current), the gas powered appliance can determine if a flame is present on the burner.

Moreover, the amount of current that will flow from the electrode varies somewhat depending on the strength of the flame. That is, a small or spluttering flame will allow less current to flow than a strong, normal flame. The flame current typically will have both a DC and an AC component. In some appliances, the DC portion of the current is used to indicate flame strength. Thus, at least some gas powered appliances attempt to monitor the value of the DC current to estimate the strength of the flame. Because the current flowing from the electrode and through the flame is very small (the DC portion is typically less than five microamps DC), such strength estimation is typically very coarse, providing only three levels: strong flame, weak flame, and no flame. Often the weak flame level is very close to the no flame level so not much warning time that something is wrong is available. Once the weak flame level is reached, there is not much decrease in current until the flame will not be able to be detected and a no flame condition will exist and the appliance will not be able to provide function.

Because the flame sensor electrode is present in the combustion chamber near the flame of the gas powered appliance, the electrode typically becomes coated with deposits from the combustion. These deposits insulate the electrode, thereby reducing the current that can flow from the electrode. Thus, the amount of current flowing from the electrode may also be an indication of the condition of the electrode of the flame sensor. That is, a low current may indicate a weak flame, a dirty sensor electrode, or both.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

According to one aspect of the present disclosure, a gas powered appliance includes a main burner for burning gas, a flame sensor assembly, and a controller. The flames sensor assembly includes a probe positioned proximate the main burner to couple an electric current to the main burner through a flame on the main burner and not to couple an electric current to the main burner when the flame is not present on the main burner, a flame detector circuit that provides a digital signal that indicates presence or absence of the flame on the main burner based on the electric current provided through the probe, and a flame strength circuit that receives a voltage on a component of the flame detector circuit and outputs an analog signal based on the voltage. The controller is connected to the flame sensor assembly and programmed to control the main burner to selectively generate heat, receive the digital signal from the flame detector circuit, receive the analog signal from the flame strength circuit, and determine, based at least in part on the analog signal from the flame strength circuit, a strength of the flame on the main burner.

Another aspect of this disclosure is a gas powered furnace including a combustion chamber, a main burner disposed in the combustion chamber for burning gas, a flame sensor assembly, and a controller connected to the flame sensor assembly. The flame sensor assembly includes a probe positioned proximate the main burner in the combustion chamber to couple an electric current to the main burner through a flame on the main burner and not to couple an electric current to the main burner when the flame is not present on the main burner, a flame detector circuit that provides a digital signal that indicates presence or absence of the flame on the main burner based on the electric current provided through the probe, and a flame strength circuit that receives a voltage on a component of the flame detector circuit and outputs an analog signal based on the voltage. The controller is programmed to control the main burner to selectively generate heat, receive the digital signal from the flame detector circuit, receive the analog signal from the flame strength circuit, determine, based at least in part on the digital output from the flame detector circuit, whether or not a flame is present on the main burner, and determine, based at least in part on the analog signal from the flame strength circuit, a strength of the flame on the main burner.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

For conciseness, examples will be described with respect to a gas powered furnace. However, the methods and systems described herein may be applied to any suitable gas powered appliance, including without limitation a gas powered dryer, a gas powered water heater, a gas powered oven.

Figure 1:
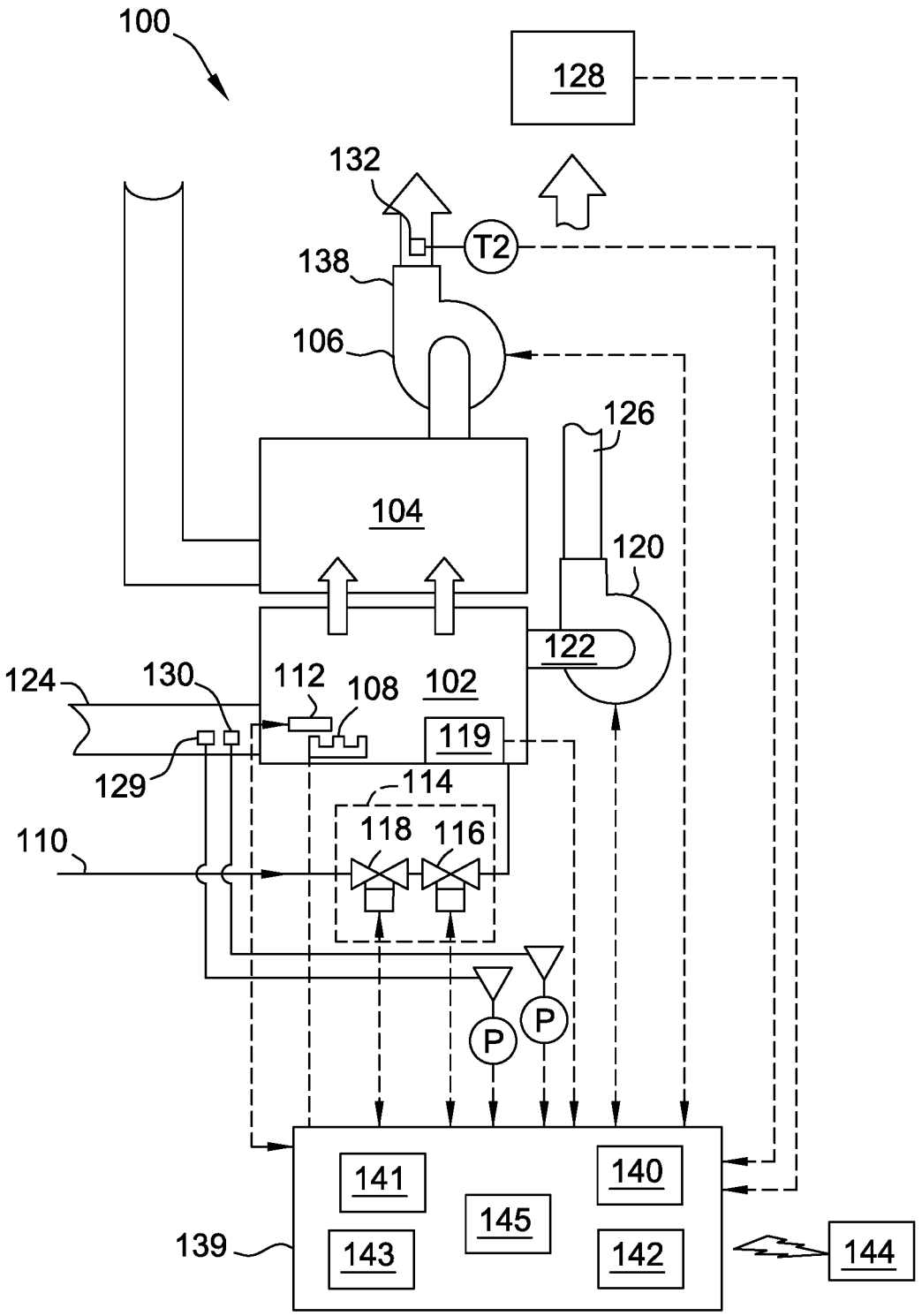
FIG. 1 is a schematic diagram of a gas furnace system including a furnace control system.

Referring initially to FIG. 1, a gas furnace system of one embodiment for heating a temperature controlled environment is indicated generally at 100. The gas furnace system 100 generally includes a combustion chamber 102 for generating heat from combustible gases, a heat exchanger 104, and an air circulator 106 for circulating fluid (e.g., air) past the heat exchanger 104 to transfer heat generated by the combustion chamber 102 to the circulating fluid.

The combustion chamber 102 includes a burner 108 connected to a gas fuel supply (not shown) via a gas inlet 110, and an ignition device 112, such as a hot surface ignitor, a spark ignitor, an intermittent pilot, or the like configured to ignite an air/fuel mixture within the combustion chamber 102. The burner 108 includes one or more burners through which fuel gas is fed. The supply of fuel gas to the burner 108 is controlled by a gas valve assembly 114, which, in the illustrated embodiment, includes a main burner valve 116 and a safety valve 118. In embodiments in which the ignition device 112 is an intermittent pilot, a supply of fuel gas to the intermittent pilot is controlled by a pilot gas valve (not shown). A flame sensor 119 (also sometimes referred to as a flame probe) is positioned near the burner 108 for use detecting the presence or absence of a flame produced by the burner 108 and the strength of the produced flame.

An inducer blower 120 (also referred to as a draft inducer) is connected to the combustion chamber 102 by a blower inlet 122. The inducer blower 120 is configured to draw fresh (i.e., uncombusted) air into the combustion chamber 102 through an air inlet 124 to mix fuel gas with air to provide a combustible air/fuel mixture. The inducer blower 120 is also configured to force exhaust gases out of the combustion chamber 102 and vent the exhaust gases to atmosphere through an exhaust outlet 126. The inducer blower 120 includes a motor (not shown), that drives a fan, impeller, or the like to move air.

The combustion chamber 102 is fluidly connected to the heat exchanger 104. Combusted gases from the combustion chamber 102 are circulated through the heat exchanger 104 while the air circulator 106 forces air from the temperature controlled environment into contact with the heat exchanger 104 to exchange heat between the heat exchanger 104 and the temperature controlled environment. The air circulator 106 subsequently forces the air through an outlet 138 and back into the temperature controlled environment.

The operation of the system 100 is generally controlled by a furnace control system 139, which includes a safety system 140, a fan control 142, a processor 141, a memory 143, a spark ignition controller 145, each of which may be a separate controller or one or more of which may be embodied in a single controller. A thermostat 128 is connected to the furnace control system 139. Other embodiments may use hot surface ignition or a standing pilot rather than direct spark ignition using a spark ignition controller. The thermostat 128 is connected to one or more temperature sensors (not shown) for measuring the temperature of the temperature controlled environment. The furnace control system 139 is connected to each of the gas valve assembly 114, the ignition device 112, the inducer blower 120, and the air circulator 106 for controlling operation of the components in response to control signals received from the thermostat 128. Generally, the fan control 142 controls operation of the air circulator 106 and inducer blower 120, and the safety system 140 monitors and protects against safety failures (such as failure of ignition during an attempt to light gas at the burner 108). The spark ignition controller 145 controls the main gas valve, the pilot gas valve (if applicable), and the ignition device 112 to ignite gas at the burner 108 when desired. The furnace control system 139 is communicatively connected to the flame sensor 119 that detects whether or not a flame has been ignited on the burner 108 and/or on an intermittent pilot (where applicable). In some embodiments, the flame sensor 119 is communicatively connected to the spark ignition controller 145. Moreover, in some embodiments, one or both of the safety system 140 and the fan control 142 are integrated with the spark ignition controller 145. In still other embodiments, the spark ignition controller 145 functions are performed by the furnace control system 139 without a separate spark ignition controller 145. A mobile device 144, such as a mobile phone, a tablet computing device, a laptop computing device, a smart watch, or the like, may be used for wireless communication with the furnace control system 139 and/or the spark ignition controller 145. Other embodiments are not configured for communication with a mobile device 144.

The processor 141 is configured for executing instructions to cause the furnace control system 139 to perform as described herein. In some embodiments, executable instructions are stored in the memory 143. The processor 141 may include one or more processing units (e.g., in a multi-core configuration). The memory 143 is any device allowing information such as executable instructions and/or other data to be stored and retrieved. The memory 143 may include one or more computer-readable media. The memory 143 stores computer-readable instructions for control of the system 100 as described herein. The methods described herein may be encoded as executable instructions embodied in a computer-readable medium including, without limitation, memory 143 or any other storage device and/or memory device. Such instructions, when executed by a processor, cause the processor to perform at least a portion of the methods described herein.

The term processor, as used herein, refers to central processing units (CPU), microprocessors, microcontrollers, reduced instruction set circuits (RISC), application specific integrated circuits (ASIC), programmable logic circuits (PLC), logic circuits, and any other circuit or processor capable of executing the functions described herein. The above are examples only, and are thus not intended to limit in any way the definition and/or meaning of the term "processor."

The term memory, as used herein, may include, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM).

The above memory types are example only, and are thus not limiting as to the types of memory usable for storage of data, instructions, and/or a computer program.

Figure 2:
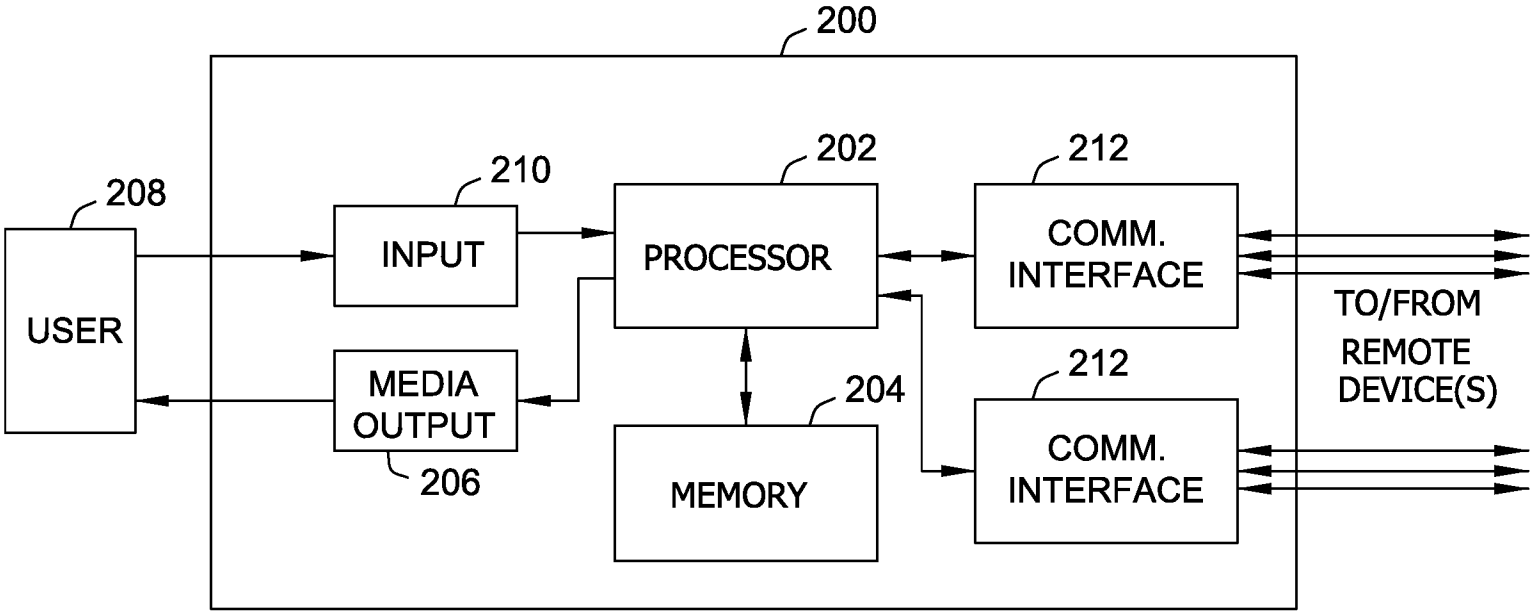
FIG. 2 is a block diagram of a computing device for use in the furnace system shown in FIG. 1.

FIG. 2 is an example configuration of a computing device based controller 200 for use as a controller for safety system 140, fan control 142, a spark ignition controller 145, and/or as the processor 141 and memory 143 in the control system 139. The controller 200 includes a processor 202, a memory 204, a media output component 206, an input device 210, and communications interfaces 212. Other embodiments include different components, additional components, and/or do not include all components shown in FIG. 2.

The processor 202 is configured for executing instructions. In some embodiments, executable instructions are stored in the memory 204. The processor 202 may include one or more processing units (e.g., in a multi-core configuration). The memory 204 is any device allowing information such as executable instructions and/or other data to be stored and retrieved. The memory 204 may include one or more computer-readable media.

The media output component 206 is configured for presenting information to user 208. The media output component 206 is any component capable of conveying information to the user 208. In some embodiments, the media output component 206 includes an output adapter such as a video adapter and/or an audio adapter. The output adapter is operatively connected to the processor 202 and operatively connectable to an output device such as a display device (e.g., a liquid crystal display (LCD), organic light emitting diode (OLED) display, cathode ray tube (CRT), "electronic ink" display, one or more light emitting diodes (LEDs)) or an audio output device (e.g., a speaker or headphones).

In an example embodiment, the media output 206 is connected to a display device (not shown) on the gas furnace system that displays an indication of the strength of the flame produced by the burner 108, as detected by the flame sensor 119. In some embodiments, the display device is a display on the thermostat 128. The indication of the strength of the flame may be represented on the display device by a displayed number (e.g., a percentage, a number within a predefined range of numbers, or the like), by the number of lighted LEDs in a group of LEDs, by the brightness of a light (e.g., brighter light for a stronger flame and weaker light for a weaker flame), by the color of a light, by a displayed text description of the strength of the flame (e.g., "strong flame"), or by any other suitable display of the absolute or relative strength of the flame detected by the flame sensor 119. Moreover, the flame sensor 119 operates through use of an electric current flowing through the flame produced by the main burner 108. In some embodiments, the furnace control system 139 displays the value of the current flowing through the flame as the indication of the strength of the flame.

The controller 200 includes, or is connected to, the input device 210 for receiving input from the user 208. The input device is any device that permits the controller 200 to receive analog and/or digital commands, instructions, or other inputs from the user 208, including visual, audio, touch, button presses, stylus taps, etc. The input device 210 may include, for example, a variable resistor, an input dial, a keyboard/keypad, a pointing device, a mouse, a stylus, a touch sensitive panel (e.g., a touch pad or a touch screen), a gyroscope, an accelerometer, a position detector, or an audio input device. A single component such as a touch screen may function as both an output device of the media output component 206 and the input device 210.

The communication interfaces 212 enable the controller 200 to communicate with remote devices and systems, such as sensors, valve control systems, safety systems, remote computing devices, and the like. The communication interfaces 212 may be wired or wireless communications interfaces that permit the computing device to communicate with the remote devices and systems directly or via a network. Wireless communication interfaces 212 may include a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Washington; ZigBee is a registered trademark of the ZigBee Alliance of San Ramon, California.) Wired communication interfaces 212 may use any suitable wired communication protocol for direct communication including, without limitation, USB, RS232, I2C, SPI, analog, and proprietary I/O protocols. In some embodiments, the wired communication interfaces 212 include a wired network adapter allowing the computing device to be coupled to a network, such as the Internet, a local area network (LAN), a wide area network (WAN), a mesh network, and/or any other network to communicate with remote devices and systems via the network.

The memory 204 stores computer-readable instructions for control of the gas furnace system 100 as described herein. In some embodiments, the memory area stores computer-readable instructions for providing a user interface to the user 208 via media output component 206 and, receiving and processing input from input device 210.

Figure 3:
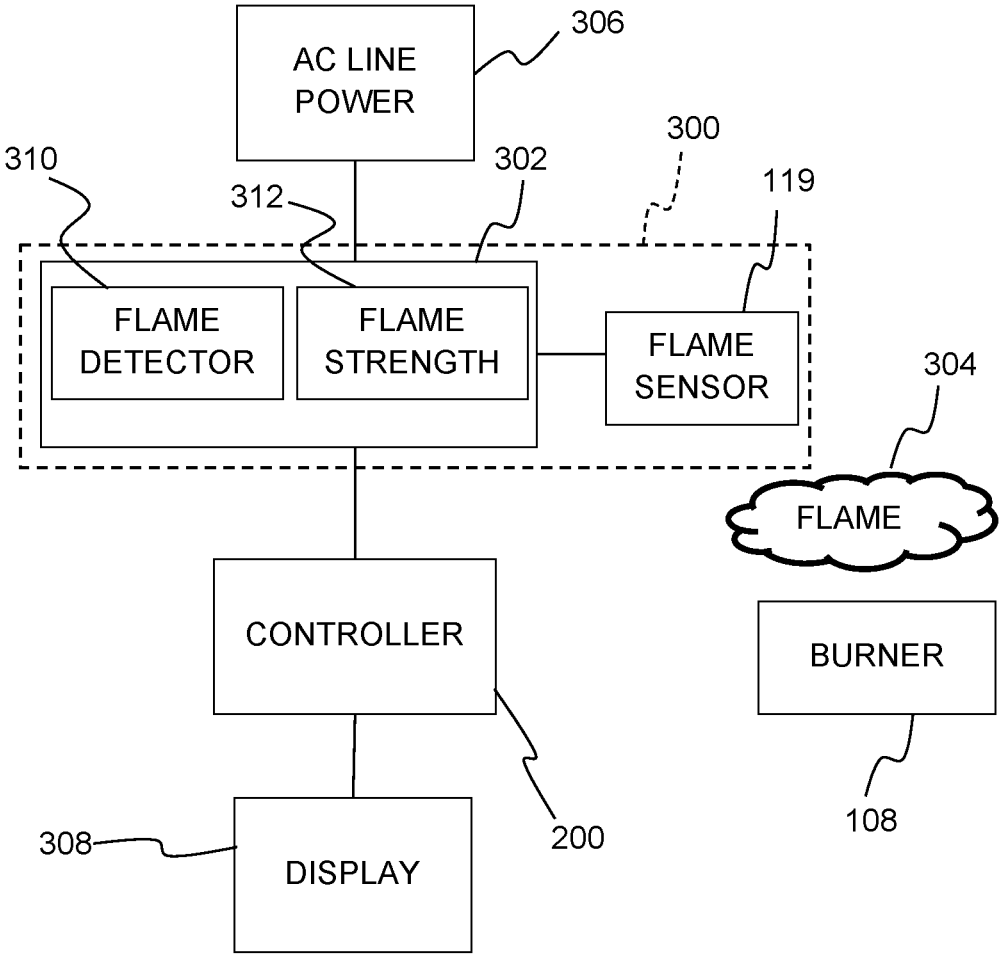
FIG. 3 is a block diagram of a portion of the furnace shown in FIG. 1 including a flame sensor assembly.

FIG. 3 is a block diagram of a portion of the gas furnace system 100 including a flame sensor assembly 300. The flame sensor assembly 300 includes the flame sensor 119 and a flame probe circuit 302 coupled to the flame sensor 119. The flame probe circuit 302 and the controller 200 form at least part of the furnace control system 139.

The flame sensor 119 is positioned proximate the burner 108 to couple an electric current to the burner 108 through a flame 304 on the burner 108 and not to couple an electric current to the burner 108 when the flame is not present on the burner 108. That is, when flame 304 is not present (e.g., because furnace is not operating to produce heat or because flame 304 has not been ignited on the burner 108 because of a failure), an open circuit exists between the flame sensor 119 and the burner 108. When the flame 304 exists, the flame (and the ionized gases around the flame) close the circuit between the burner 108 and the flame sensor 119, thereby allowing a small electrical current, consisting of an AC and a DC component, (influenced from AC power source 306) to flow from the flame sensor 119 to the burner 108.

The flame probe circuit 302 includes a flame detector circuit 310 and a flame strength circuit 312. The flame detector circuit 310 functions as a detector that detects when current is flowing from the flame probe to the burner and provides to the controller 200 signals representative of the electric current provided through the flame sensor 119. The signals are digital signals that indicate either the flame 304 is present or the flame 304 is absent. The actual flame probe current is an AC current plus a DC current, the presence or absence of which is converted to the digital signal. When the flame 304 is present, current has been flowing from the flame probe to the burner, and the system is in a substantially steady state, the flame probe circuit 302 outputs a substantially constant logic high signal to the controller 200. When the flame 304 is not present, current has not been flowing from the flame probe to the burner, and the system is in a substantially steady state, the flame probe circuit 302 outputs a substantially constant logic low signal to the controller 200. Alternatively, a logic low signal may be used for the presence of the flame 304 and a logic high signal may be used for the absence of the flame 304.

The flame strength circuit 312 receives as an input a value from the flame detector circuit 310 that varies as a function of the amount of current flowing between the flame sensor 119 and the burner 108 through the flame 304. In the example embodiment, the value is a voltage on a component (such as a MOSFET or other switch) of the flame detector circuit 310. The flame strength circuit 312 conditions the input into a voltage signal that is within the acceptable range for an analog input pin of the controller 200. The control system 139 (and specifically the controller 200) is programmed to determine the strength of the flame based at least in part on the voltage signal received from the flame strength circuit 312.

The strength of the flame 304 may be determined as a flame current amount, a relative strength of flame (e.g., high, medium high, medium, medium low, low, no flame, and the like), a relative strength on a numerical scale (e.g., maximum flame=10, no flame=zero, and numbers between 0 and 10 indicate relative strengths between maximum flame and no flame), or as any other suitable representation of the strength of the flame 304. In the example embodiment, the control system 139 determines the strength of flame from more than three possible strengths of flame. That is, the control system 139 is programmed to determine an indication of the strength of the flame as an indication of one of a plurality of predetermined strengths, where the plurality of predetermined strengths is more than three strengths. Thus, the example system provides more granular information about the strength of flame than some known systems, which typically only determine the presence or absence of a flame, and possibly a low flame level between the two. In the example, each flame strength level represents a range of flame currents. Alternatively, each flame strength level may represent a specific flame current.

Figure 4:
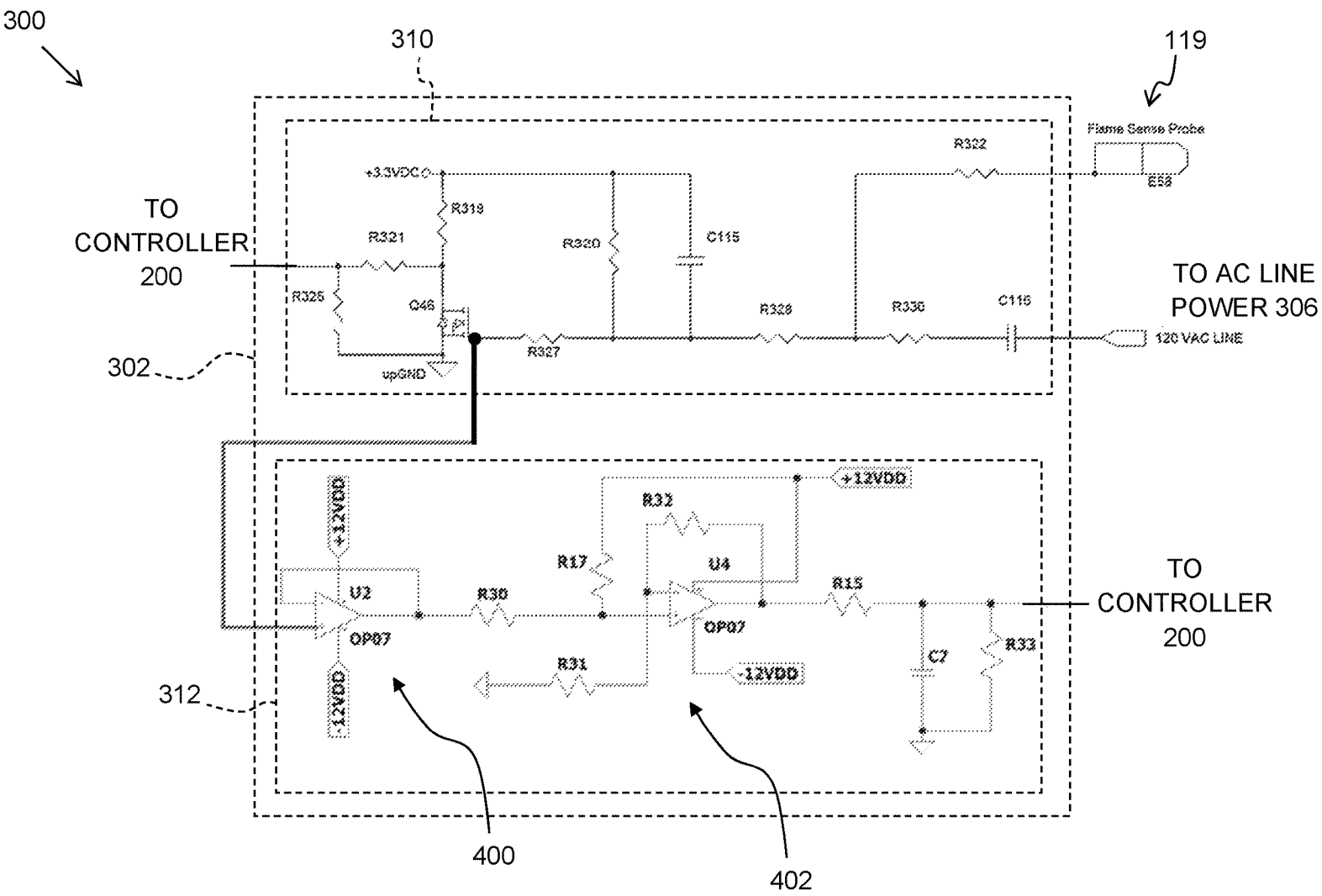
FIG. 4 is a circuit diagram of an embodiment of the flame sensor assembly shown in FIG. 3.

FIG. 4 is a circuit diagram of an example flame probe circuit 302 for use in the flame probe assembly 300. With respect to the flame detector circuit 310, when no current is flowing from the flame sensor 119 to the burner 108, the gate of the MOSFET Q46 is sufficiently high voltage to turn on (i.e., make conducting) the MOSFET Q46, thus making the voltage on R321 low with respect to 3.3 VDC and thus a low DC voltage or no voltage (e.g., 0V) is output to controller 200 as a logical low signal indicating that no flame is detected. When current begins to flow from flame sensor 119 to the burner 108 because a flame has been ignited, the voltage on the gate of the MOSFET Q46 will have a DC and AC component and will move lower with time. As this voltage crosses the turn on voltage of the gate of FET Q46, because of the AC component, Q46 will be alternately turned ON and OFF. This will cause the voltage on R321 to alternately be Low and High respectively. In this state, the signal sent to controller 200 will be alternating low and high. If the flame current is high enough to pull the voltage of the gate of FET Q46 to where even with the AC component the voltage is always below the FET Q46 turn on voltage, then the FET will remain OFF and the voltage on R321 will be High and the signal sent to controller 200 will be high, or close to 3.3 VDC, indicating that a flame is present. Thus, during this length of time, the control system 139 receives a pulsating signal that fluctuates between indicating that a flame is present and no flame is present. As the flame increases and the system reaches a steady state, the voltage on the gate of the MOSFET Q46 will reach a steady state at a low voltage keeping the MOSFET Q46 off, and providing a substantially constant logic high signal to the controller 200, thereby indicating that the flame is detected. A similar process happens, when the flame on the burner 108 is extinguished. That is, the previously constant logic high signal begins to pulse between high and low until a steady state is reached, the MOSFET Q46 remains on, and a substantially constant low signal is output to the controller 200.

As explained above, the voltage on the gate of the MOSFET Q46 varies depending on how much current is flowing from the flame sensor 119 to the burner 108. Specifically, when there is no flame (and thus no current), the voltage on the gate of the MOSFET Q46 is a high value. When there is a strong flame, the flame sensor 119 is clean and in good shape, and there is a large flame current, the voltage on the gate of the MOSFET Q46 is pulled to a low value. When the flame current is between no flame current and the strongest flame current, the voltage on the gate of the MOSFET Q46 will be between the low value and the high value. Thus, the voltage on the gate of MOSFET Q46 may be used as an indication of the flame current and the strength of the flame on the burner 108.

The flame strength circuit 312 is an analog signal conditioning circuit by which the flame current can be measured on an analog scale. This gate voltage of the MOSFET Q46 is used as an input signal to the flame strength circuit 312. The flame strength circuit 312 converts this FET gate voltage into a voltage within a voltage range acceptable to the controller 200 so that it can be measured by an analog input pin (not shown) of the controller 200. The exact voltage on the MOSFET Q46 is the function of flame current (as discussed above) and line voltage. So long as the line voltage and gate voltage of the MOSFET Q46 are known, the flame current can be determined. The gate voltage of the MOSFET Q46 is applied to a non-inverting buffer 400. The non-inverting buffer 400 is high gain buffer that causes little to no significant loading effect on MOSFET Q46 gate voltage. The output of the non-inverting buffer 400 is then applied to a non-inverting amplifier 402 that converts the signal to a voltage between zero volts and an operating voltage (Vdd) that can be received and measured by an analog input of the controller 200. The values of the components and the specific components used may be varied to widen the flame current measurement band, to accommodate different gas powered appliances, to accommodate different operating voltages, and the like.

Figure 5:
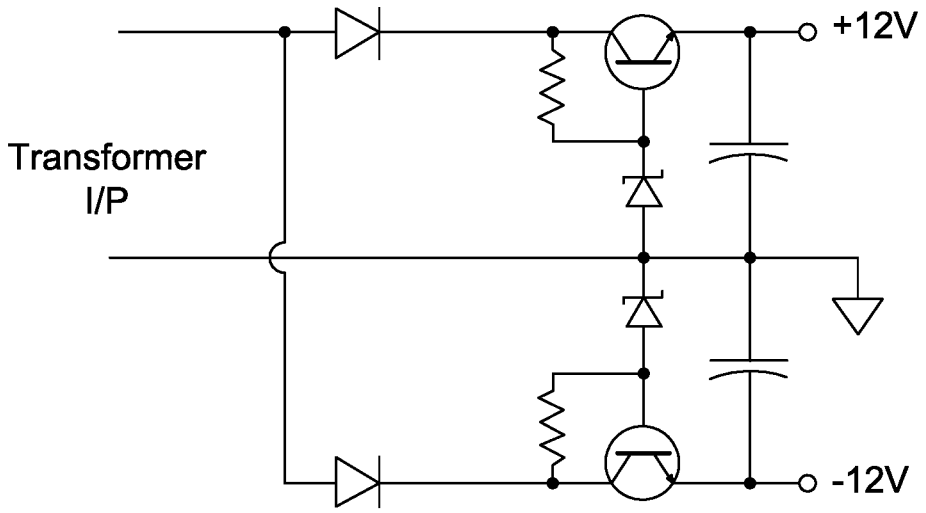
FIG. 5 is a power supply circuit for powering part of the circuit shown in FIG. 4.

FIG. 5 is an example circuit 500 that may be used to provide the +/−12V power for use by the flame strength circuit 312. The circuit 5000 takes an input voltage from a transformer (not shown) and converts it to +12 volt and −12 volt supplies.

Figure 6:
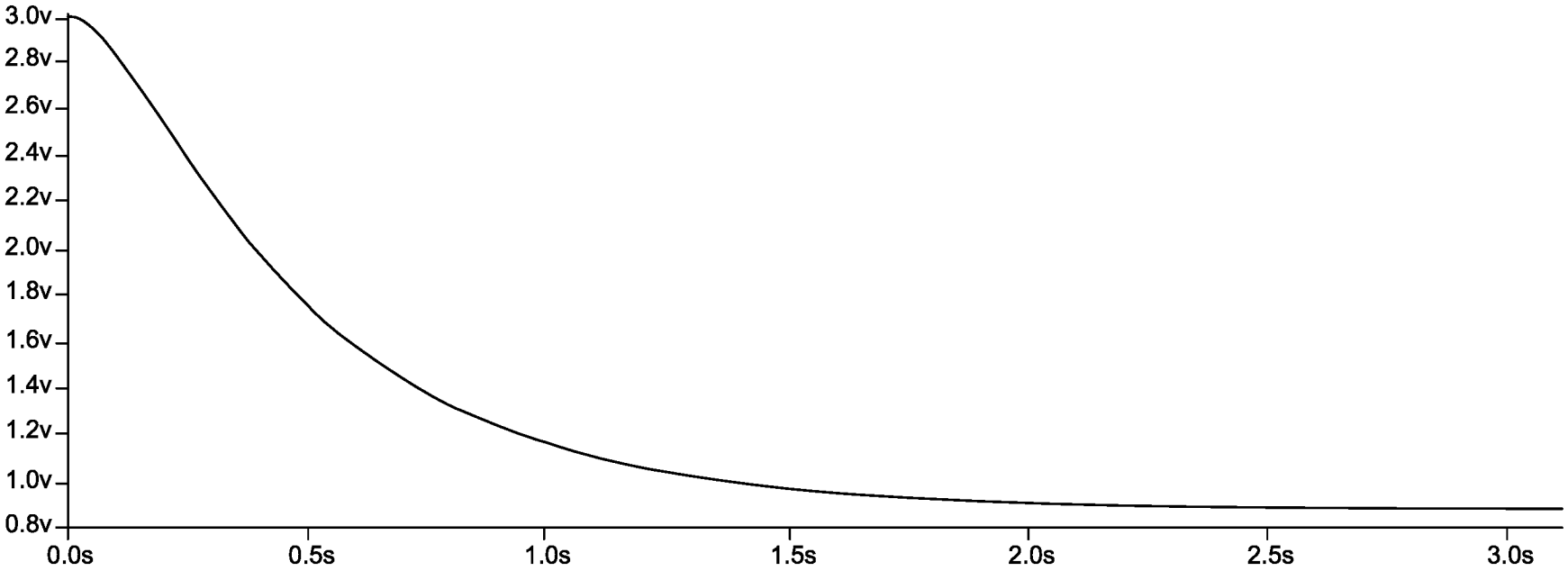
FIG. 6 is a graphs of the output of the flame probe circuit when the flame current is three microamps.
Figure 7:
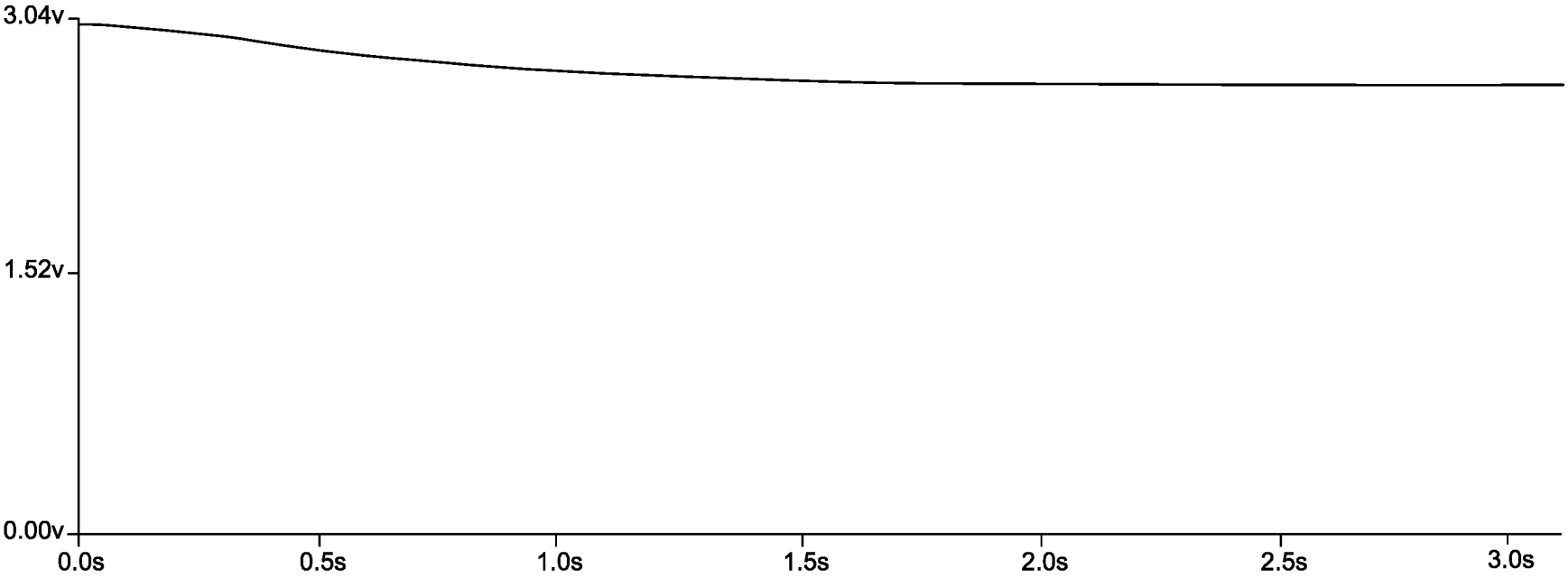
FIG. 7 is a graphs of the output of the flame probe circuit when the flame current is 0.4 microamps.

FIG. 6 is a graph of an output of the example flame strength circuit 312 of FIG. 4 when the flame current flowing between the flame sensor 119 and the burner 108 is three microamps. FIG. 7 is a graph of an output of the example flame strength circuit 312 of FIG. 4 when the flame current flowing between the flame sensor 119 and the burner 108 is 0.4 microamps. As can be seen, both outputs begin around three volts. When the output reaches a steady state, the three microamp flame current results in a low output of about 0.9 volts, while the 0.4 microamp flame current causes a relatively high voltage output of about 2.6 volts.

The controller 200 is programmed to receive the output of the flame strength circuit 312 and determine the strength of flame based on the voltage of the output once it reaches a steady state. The determination may be based on a calculation using a formula, retrieving the flame strength from a lookup table or the like, by comparison to previous voltages corresponding to known absolute or relative flame strengths, or by any other suitable techniques.

For example, the control system 139 (and specifically the controller 200) compares the output voltage of the flame strength circuit 312 to data stored in the memory 204 that indicates correspondences between voltages and the strength of the flame (or the value of the flame current as a representative of the strength of the flame). In some embodiments, the data is predetermined and has fixed correspondences. In other embodiments, the data is variable depending on the magnitude of the voltage output by the AC power source 306. This may be achieved by inclusion of multiple sets of correspondences, one for each of a plurality of different AC voltages, or by including one set of correspondences and scaling factors to adjust the one set of correspondences for different AC voltages. Embodiments that determine the strength of flame based in part on the voltage of the AC power source 306 may also include a voltage sensor (not shown) to detect the voltage input by from the AC power source 306. Alternatively, a user may input the voltage of the AC power source 306 to the control system 139, such as via input 210.

In other embodiments, the control system 139 may calculate the strength of the flame (or the value of the flame current as a representative of the strength of the flame) based on the output voltage of the flame strength circuit 312.

In some embodiments, the control system 139 is programmed to set initial values for the flame current in response to a received user input (such as via input 210) and determine future strengths of flame relative to those initial values. For example, this setting may be performed when the system 100 is first assembled and/or any time the flame sensor 119 is replaced or cleaned. Thus, the control system 139 may learn the maximum flame strength when the flame probe is new (or newly replaced) and determine subsequent flame strengths relative to the maximum flame strength detection of the particular flame sensor 119 when new. For example, the control system 139 may store, in the memory 204, an initial output of the flame strength circuit 312 as a maximum flame strength in response to a received input from a user. The control system 139 then determines a plurality of voltages greater than the initial output voltage as corresponding to a plurality of flame strength levels less than the maximum flame strength. Subsequently, when the controller 200 receives signals from the flame strength circuit 312, the control system 139 determines the strength of the flame on the burner 108 by comparison of the output voltage of the flame strength circuit 312 to the correspondences stored in the memory. In other embodiments, the control system 139 may store, in the memory 204, an initial output voltage of the flame strength circuit 312 as a maximum flame strength in response to a received input from a user, without calculating the plurality of voltages greater than the initial output voltage. Rather, in such embodiments, when the controller receives subsequent signals from the flame strength circuit 312, the controller determines the strength of the flame on the burner 108 by comparison of the output of the flame strength circuit 312 to the initial output voltage.

In the example embodiment, the control system 139 displays on a display 308, an indication of the strength of the flame determined by the control system 139. The display may be displayed as a number or a word on the display 308, when the display 308 is capable of displaying numbers and/or text. For example, the display may be of a number on an arbitrary scale (e.g., a number between 1 and 10, with 10 being maximum flame), a percentage of the maximum flame, a word description of the flame strength (e.g., "maximum flame," "medium flame," and the like), the magnitude of the flame current determined by the control system 139, or any other suitable text or numerical display. Alternatively, the display may be a symbolic display, such as lighting a particular number of lights (e.g., LEDs) on the display 308, lighting a particular light that indicates a particular flame strength (e.g., a light next to a printed label that reads "maximum flame"), lighting different colored lights (or changing the color or a single light) to indicate the strength of flame (e.g., green for maximum flame strength, red for no flame, and various other colors for flame strengths between maximum flame and no flame), or any other suitable symbolic display of the flame strength level. In some embodiments, the display 308 is a display on the mobile device 144, and the control system 139 outputs the indication of the strength of the flame to the mobile device 144 for display on the screen of the mobile device.

The control system 139 is programmed in some embodiments to output an alert when the determined strength of the flame on the burner 108 is less than a threshold value indicating a strong flame and greater than a threshold value indicating no flame is present. That is, an alert threshold value between no flame and maximum flame is stored in the memory 204. When the control system 139 determines a flame strength that is less than the alert threshold value, the control system 139 outputs an alert to indicate that a low flame is present and/or the flame sensor 119 is dirty or faulty. The alert may be a human cognizable alert, such as a visible alert (e.g., lighting an alert light, flashing on or more lights, displaying "alert" on the display 308, or the like), or an audible alert (e.g., ringing a bell, sounding a siren, playing a melody through a speaker, or the like). Additionally, or alternatively, the alert may be an electronic alert, such as a signal output from the communication interface 212 to a remote computing device, such as the mobile device 144. The remote computing device may be a monitoring computer, the user's computer, the user's mobile communication device (e.g., a cell phone, tablet, or the like), a smart home hub, or any other suitable remote computing device. In some embodiments, the control system 139 stores, in the memory 204, an indication that the alert was sent and data about the alert (e.g., determined length of time, determined flame strength, date of occurrence, time of day, input voltage, and/or other suitable data). This data may then be accessed by the user or a repair person either through the user interface or remotely.

In some embodiments, the control system 139 makes at least some determinations by comparison of historical data about the flame current. In such embodiments, the control system 139 stores the determined flame currents in the memory 204 during operation. In some embodiments, the control system 139 analyzes that stored data to estimate when the flame sensor 119 will need to be repaired, cleaned, or replaced. As explained above, over time the flame sensor 119 will accumulate an insulating coating that will gradually decrease the current that flows through the flame sensor 119 (even under otherwise same conditions). By comparing previous measurements, a rate of decline in the measured flame current can be determined, and the time when the measured flame current will be too low can be estimated. This time may be stored in the memory 204 for retrieval by a user or repair person, or may be transmitted to a remote computing device (similar to the alerts discussed above). Similarly, by storing the previous flame current determinations, the control system 139 may compare the present flame current determination to the previous determinations to identify anomalous determinations. For example, over a long period of time, the determined flame current will gradually (and relatively smoothly) decrease at a determinable rate. If a present time determination varies significantly (i.e., much more than the determined rate of decrease), the controller may determine that there may be a problem with the water heater 20, such as a catastrophic failure of the flame sensor 119, damage/contamination of the burner 108 resulting in a significantly lower flame, or the like. In such circumstances, the control system 139 may output an alert similar to the alerts discussed above so that the water heater 20 may be inspected, cleaned, and repaired as needed.

Embodiments of the methods and systems described herein achieve superior results compared to prior methods and systems. The systems are operable to detect multiple flame current levels to provide a more detailed view of the operation of the gas powered appliance. Moreover, the example systems and methods do so without the need for a sensitive current sensor capable of detecting differences of a few microamps of current. Further the example methods and systems may provide early warning of the need for appliance maintenance, and/or flame probe replacement or repair. On installations where the flame probe is not located correctly to give a good flame signal, the methods and systems of this disclosure allow the poor location to be detected early during installation and corrected. For appliances, such as gas furnaces, that may be inspected infrequently (e.g., once per year), the example systems and methods allow for more accurate estimation of whether or not the appliance will last until the next inspection without needing service on the flame probe by providing better/earlier warning of a failing/dirty probe.

Example embodiments of systems and methods for controlling a furnace are described above in detail. The system is not limited to the specific embodiments described herein, but rather, components of the system may be used independently and separately from other components described herein. For example, the controller and processor described herein may also be used in combination with other systems and methods, and are not limited to practice with only the system as described herein.

When introducing elements of the present disclosure or the embodiment (s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing (s) shall be interpreted as illustrative and not in a limiting sense.

What is claimed is:

1. A gas powered appliance comprising:

a main burner for burning gas;

a flame sensor assembly including:

a probe positioned proximate the main burner to couple an electric current to the main burner through a flame on the main burner and not to couple an electric current to the main burner when the flame is not present on the main burner;

a flame detector circuit that provides a digital signal that indicates presence or absence of the flame on the main burner based on the electric current provided through the probe; and a flame strength circuit that receives a voltage on a component of the flame detector circuit and outputs an analog signal based on the voltage; and a controller connected to the flame sensor assembly, the controller programmed to:

control the main burner to selectively generate heat;

receive the digital signal from the flame detector circuit;

receive the analog signal from the flame strength circuit; and determine, based at least in part on the analog signal from the flame strength circuit, a strength of the flame on the main burner.

2. The gas powered appliance of claim 1, wherein the voltage on the component of the flame detector circuit comprises a gate voltage on a MOSFET of the flame detector circuit.

3. The gas powered appliance of claim 2, wherein the flame detector circuit is configured to have a first gate voltage of a first magnitude when no electric current is coupled between the probe and the main burner and a second gate voltage of a second magnitude lower than the first magnitude when the electric current is coupled between the probe and the main burner through the flame on the main burner.

4. The gas powered appliance of claim 3, wherein the second magnitude decreases as the electric current coupled between the probe and the main burner through the flame on the main burner increases.

5. The gas powered appliance of claim 1, wherein the flame detector circuit is at least partially powered by a source voltage, and the controller is programmed to determine the strength of the flame on the main burner based on the analog signal from the flame strength circuit and a magnitude of the source voltage.

6. The gas powered appliance of claim 1, wherein the flame strength circuit comprises a high impedance buffer coupled to receive the voltage on the component of the flame detector circuit and an amplifier coupled to receive an output of the high impedance buffer and to output the analog signal to the controller.

7. The gas powered appliance of claim 6, wherein the high impedance buffer and the amplifier are both non-inverting.

8. The gas powered appliance of claim 6, wherein the amplifier is configured to output the analog signal in a voltage range that may be received by an analog input of the controller.

9. The gas powered appliance of claim 1, further comprising a display, wherein the controller is further programmed to display, on the display, an indication of the strength of the flame determined by the controller.

10. The gas powered appliance of claim 9, wherein the indication of the strength of the flame comprises an indication of one of a plurality of predetermined strengths, and the plurality of predetermined strengths comprises more than three strengths.

11. The gas powered appliance of claim 1, wherein the controller comprises a memory storing correspondences between different flame strengths and different voltages, and wherein the controller is programmed to determine the strength of the flame on the main burner by comparison of the analog signal to the correspondences stored in the memory.

12. The gas powered appliance of claim 1, wherein the controller comprises a memory, and the controller is programmed to:

store, in the memory, an initial voltage of the analog signal as a maximum flame strength in response to a received input from a user;

determine a plurality of voltages greater than the initial voltage as corresponding to a plurality of flame strength levels less than the maximum flame strength; and determine the strength of the flame on the main burner at a later time by comparison of a later voltage of the analog signal to the correspondences stored in the memory.

13. The gas powered appliance of claim 1, wherein the controller comprises a memory, and the controller is programmed to:

store, in the memory, an initial voltage of the analog signal as a maximum flame strength in response to a received input from a user; and determine the strength of the flame on the main burner at a later time by comparison of a later voltage of the analog signal to the initial voltage.

14. The gas powered appliance of claim 1, wherein the controller is programmed to output an alert when the determined strength of the flame on the main burner is less than a threshold value indicating a strong flame and greater than a threshold value indicating no flame is present.

15. A gas powered furnace comprising:

a combustion chamber;

a main burner disposed in the combustion chamber for burning gas;

a flame sensor assembly including:

a probe positioned proximate the main burner in the combustion chamber to couple an electric current to the main burner through a flame on the main burner and not to couple an electric current to the main burner when the flame is not present on the main burner;

a flame detector circuit that provides a digital signal that indicates presence or absence of the flame on the main burner based on the electric current provided through the probe; and a flame strength circuit that receives a voltage on a component of the flame detector circuit and outputs an analog signal based on the voltage; and a controller connected to the flame sensor assembly, the controller programmed to:

control the main burner to selectively generate heat;

receive the digital signal from the flame detector circuit;

receive the analog signal from the flame strength circuit;

determine, based at least in part on the digital output from the flame detector circuit, whether or not a flame is present on the main burner; and determine, based at least in part on the analog signal from the flame strength circuit, a strength of the flame on the main burner.

16. The gas powered furnace of claim 15, wherein:

the voltage on the component of the flame detector circuit comprises a gate voltage on a MOSFET of the flame detector circuit;

the flame detector circuit is configured to have a first gate voltage when no electric current is coupled between the probe and the main burner and a second gate voltage having a magnitude lower than a magnitude of the first gate voltage when the electric current is coupled between the probe and the main burner through the flame on the main burner; and the magnitude of the second gate voltage decreases as the electric current coupled between the probe and the main burner through the flame on the main burner increases.

17. The gas powered furnace of claim 15, wherein the flame detector circuit is at least partially powered by a source voltage, and the controller is programmed to determine the strength of the flame on the main burner based on the analog signal from the flame strength circuit and a magnitude of the source voltage.

18. The gas powered furnace of claim 15, wherein the flame strength circuit comprises a non-inverting, high impedance buffer coupled to receive the voltage on the component of the flame detector circuit and a non-inverting amplifier coupled to receive the output of the high impedance buffer and output the analog signal to the controller.

19. The gas powered furnace of claim 18, wherein the amplifier is configured to output the analog signal in a voltage range that may be received by an analog input of the controller.

20. The gas powered furnace of claim 15, further comprising a display, wherein the controller is further programmed to display, on the display, an indication of the strength of the flame determined by the controller.

* * * * *